US005491006A

United States Patent [19]

Johnson et al.

[11] Patent Number: 5,491,006

[45] Date of Patent: Feb. 13, 1996

[54] RELEASABLY MOUNTABLE WALL ORNAMENT

[75] Inventors: Constance A. Johnson, West Des Moines, Iowa; Harold L. McVeigh, West Palm Beach, Fla.

[73] Assignee: Whimsical Walls, Inc., West Des Moines, Iowa

[21] Appl. No.: 213,932

[22] Filed: Mar. 16, 1994

[51] Int. Cl.[6] ..... E04F 13/00

[52] U.S. Cl. ..... 428/13; 428/79; 428/904.4

[58] Field of Search ..... 428/79, 7, 904.4, 428/13

[56] References Cited

U.S. PATENT DOCUMENTS

| | | | |
|---|---|---|---|
| 1,475,922 | 11/1923 | Soglow | 428/48 |
| 1,648,020 | 11/1927 | Labram | 428/39 |
| 2,554,408 | 5/1951 | Hile | 428/187 X |
| 2,753,276 | 7/1956 | Brochhagen | 428/304.4 |
| 3,226,284 | 12/1965 | Curtis | 428/76 |
| 3,324,574 | 6/1967 | Markley | 428/13 X |
| 4,101,032 | 7/1978 | Obidniak | 206/457 |
| 4,160,685 | 7/1979 | Kuroda | 428/79 X |
| 4,298,414 | 11/1981 | Latapie | 156/59 |
| 4,381,618 | 5/1983 | Krisel | 428/16 X |
| 4,536,423 | 8/1985 | Travis | 428/14 |
| 4,584,218 | 4/1986 | Travis | 428/79 X |
| 4,791,740 | 12/1988 | Ferrari | 40/124 |
| 4,816,302 | 3/1989 | Shaw | 428/33 |
| 4,842,303 | 6/1989 | Molenda | 428/40 X |
| 4,900,604 | 2/1990 | Martinez | 428/79 |
| 5,149,570 | 9/1992 | Cain | 428/33 |
| 5,196,246 | 3/1993 | Kauss et al. | 428/39 |

*Primary Examiner*—Henry F. Epstein
*Attorney, Agent, or Firm*—Zarley, McKee, Thomte, Voorhees & Sease

[57] ABSTRACT

A wall ornament releasably mountable is provided with reusable adhesive. A light-weight, rigid substrate is used that is thick and conveys a three-dimension impression when the wall ornament is attached to a wall or similar planer surface. Various wall ornaments can be used together cooperatively to create a decorative wall scene. The wall ornament is easily removed and the adhesive can be reused so that unlimited theme decors can be accomplished. Possibilities for wall design include educational, fantasy, seasonal, sporting, and religious. When removed, the wall ornaments do not mar or damage wall surfaces. The wall ornaments can be professionally prepared or kits can be provided so individuals may match room decor to wall ornament.

14 Claims, 1 Drawing Sheet

RELEASABLY MOUNTABLE WALL ORNAMENT

BACKGROUND OF THE INVENTION

This invention relates generally to versatile, releasably mounted wall ornament. More particularly, this invention relates to a wall decorating system having multi-color images printed on a relatively thick and rigid medium such as foam board, being attached to a wall or similar planer surface by reusable adhesive applied to the wall engaging face of the rigid medium.

In general, the walls in the past have been decorated with paint and/or wallpaper, each of which has several drawbacks and disadvantages. Paint is not easily removable and is messy to apply. Further, if the design of the wall is to be changed, the wall must be painted over or stripped before a new design is applied. Wallpaper is relatively expensive and is difficult to install. Again, the wallpaper must be stripped before a new design is created. The permanent nature of wallpaper and paint precludes the creation of a flexible wall decoration which can be easily and quickly changed to a new configuration.

Some less permanent decorating systems utilize a plurality of pins, tacks, adhesive tape, and the like, to affix decorations onto a wall in a non-permanent fashion. Although such systems may allow for subsequent rearrangement of a decorative scene, the use of tacks and the like may permanently disfigure or damage the wall's surface. A major market for these wall designs targets bedrooms and playrooms of toddlers and small children. The use of sharp pins, tacks, and the like, in decorating a small child's room creates the potential safety hazard of the child swallowing or stepping on a tack which has worked itself loose from the wall.

Another type of decorating system found in the prior art involves the use of thin appliqués which are mounted onto a wall. These appliqués may be glued permanently in place, or rearranged continuously. If they are glued in place, they are difficult to remove and leave a thin, tacky residue which gathers dust. A removable appliqué may lose its adhesive capability over time and are expensive to replace. Also, such appliqués are merely two dimensional in nature and convey no impression of depth in their design.

As a result, there exists in the art a need for a versatile wall decorating system that is easily rearrangable into different decorative configurations after installation. Additionally, an improved wall decorating system is needed which does not permanently damage walls or painted surfaces, and which is easily and quickly installed. In addition, an improved wall decorating system should be suitable for use in a small child's room so that the changeable decorative scenes will stimulate the youngster's creativity by enabling the child to continually create new decorative arrangements. Finally, such wall ornament should be of sufficient thickness so as to convey a three-dimensional effect.

It is therefore a principal objective of the present invention to provide a wall ornament which is removable and reusable.

Another objective of the present invention is to provide a wall ornament that will not damage the wall or leave a tacky residue.

A further objective of the present invention is to provide a wall ornament which is easily and quickly installed.

A still further objective of the present invention is to provide a wall ornament suitable for a child's room.

Another objective of the present invention is to provide a wall ornament which would convey an impression of some depth or three-dimensional appearance.

A still further objective of the present invention is to provide a wall ornament durable, economical to manufacture, and safe.

Further objectives and advantages of the invention will become apparent by particularly describing a preferred embodiment thereof. For the purpose of illustrating the invention, there is shown in the drawings a form which is presently preferred; it being understood, however, that this invention is not limited to the precise arrangement and instrumentality shown.

SUMMARY OF THE INVENTION

The present invention is comprised generally of a medium containing ornament and a reusable adhesive. The adhesive is reusable and non-permanent and it permits subsequent detachment and repositioning of the ornament without losing its tackiness or ability to hold the ornament in place.

The medium on which the ornament is printed is generally a thick and rigid board manufactured of a light-weight material. Because the medium or board is relatively thick, it appears to extend from the wall or planer surface on which the ornament is attached creating a three-dimensional image.

DETAILED DESCRIPTION OF THE PREFERRED EMBODIMENT

Figure 1:
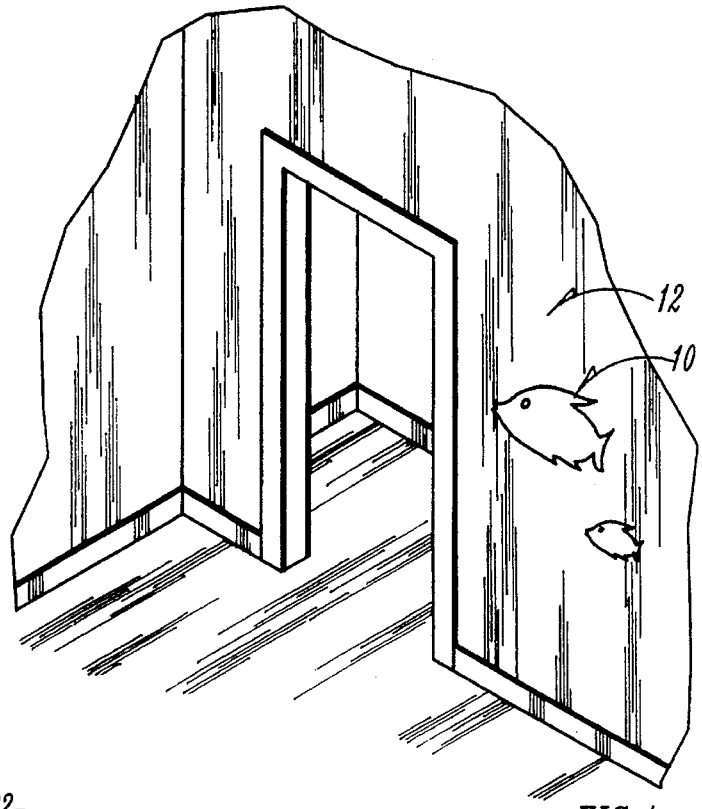
FIG. 1 is an interior perspective of a room showing placement of wall ornament.

Referring generally to the drawings, the releasably mounted wall ornament is referred to generally by the numeral 10. As shown in FIG. 1, the wall ornament 10 is generally secured to a wall 12 or other similar planar area. More than one wall ornament 10 can be placed on a wall 12 and several wall ornaments can be combined with similar themes to create a consistent impression in the ornament. Various thematic decorative scenes can be presented by merely substituting one set of ornament elements for another. Further, one wall ornament 10 can be positioned on top of another so as to further enhance the three-dimensional effect of the element's thickness.

In general, the wall ornament 10 includes a relatively thick and rigid substrate 16. The substrate 16 or board of the present invention is preferably made of a light-weight material. The substrate includes a layer of polystyrene foam 18 or other thermoplastic synthetic resin sandwiched between a backing 20 and a design surface 22 made of high-quality paperboard. The backing 20 and design surface 22 can also be constructed of a synthetic material provided it remains light-weight and capable of being decorated with paints, inks, and the like. The thickness of the substrate 16 should be in the range of ⅛ inch to ½ inch thick. The preferred thickness is ¼ inch thick. This thickness is ideal for providing a rigid, lightweight design while providing a three-dimensional appearance when the wall ornament 10 is applied to the wall 12.

An example of a substrate 16 used by the inventors is Bienfang Foam Board manufactured by Hunt Bienfang Products of Statesville, N.C. This foam board is thick and rigid, featuring warp resistance. The backing 20 and design surface 22 are extremely smooth, therefore ideal for screen printing, lithography or painting and other similar means for applying color or design. Although paints and inks adhere well to the foam boards design surface 22, because of the smooth surface 20, 22 of the foam board substrate 16, paints and inks will not significantly warp the design surface 22 or foam 18. It should be noted that a minor amount of warp is beneficial to enhance the three-dimensional effect and ease removal of the ornament 10 from wall 12.

A reusable adhesive 24 is attached to the backing 20 of substrate 16 for attachment to wall 12. While any reusable adhesive will suffice, in order to prevent harm to children when used in children's rooms, an adhesive rather than tacks, staples, tape or magnets should be used. Further, the adhesive should not harm painted walls or paneling. Two such reusable adhesives include Qwik-Tac™ from Richbond, Madison, Wisc., and Orb-Tac 214, made by Orbseal, Inc., Excelsior Springs, Mo. These adhesives are comprised generally of petroleum byproducts or hydrocarbon mixtures and are insoluble in water. Orb-Tac 214 is made from butyl rubber, a copolymer of isobutate (97%) and isoprene (3%), which is polymerized below −140° F. with an aluminum chloride catalyst. Care should be taken so that the adhesive is non-volatile and non-toxic. To be effective, however, the adhesive should be placed on several locations on the backing 20 of the substrate 16 so that adequate adhesive strength can be obtained.

The design surface 22 is adapted to receive paints, inks, decals, and the like, so that a design 26 can be placed thereon. The design surface 22 should be made of a material that has warp-resistance, but a small amount of warping should be expected. This small amount of warping allows the wall ornament 10 to appear even more three-dimensional and eases in the removal of the ornament 10 from the wall 12. However, care should be taken that the substrate 16 does not warp excessively. Should the substrate 16 or its perimeter 28 protrude unduly from wall 12, the ornament may get knocked off the wall 12 or snagged on clothing or other items and removed unnecessarily. In applying adhesive 24 it should be noted that thin applications are preferred for the same reason.

Figure 2:
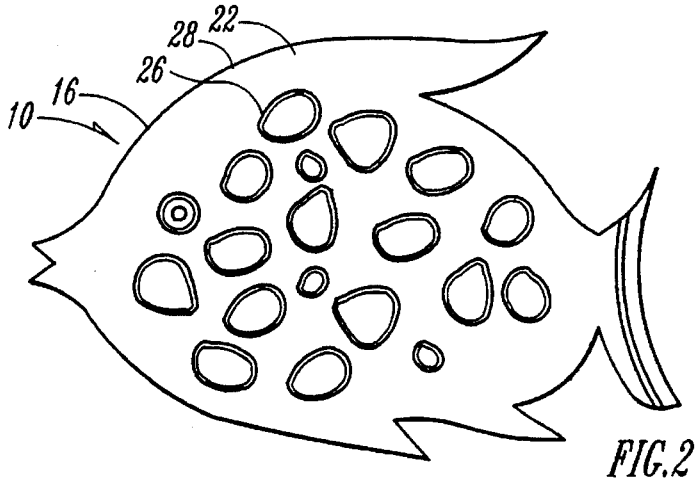
FIG. 2 is a front elevational view of a wall ornament.
Figure 3:
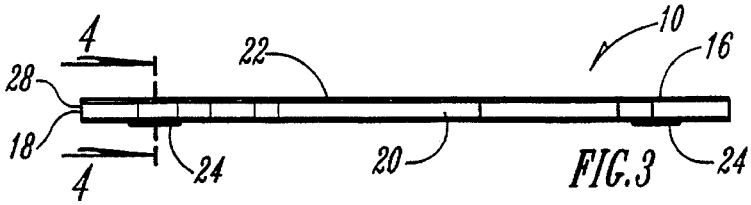
FIG. 3 is a side elevational view of a wall ornament.
Figure 4:
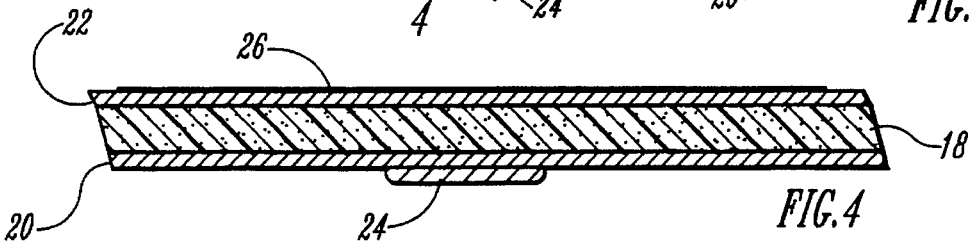
FIG. 4 is a sectional view taken along line 4—4 of FIG. 3.

As well as painting the design surface 22, the perimeter 28 of the substrate 16 can be cut or shaped to conform to the design 26. As shown in FIG. 2, the shape of the substrate 16 can have a complex outline which can easily be altered should a new design be applied.

While a particular form of the invention has been illustrated and described, it will be apparent that various modifications may be made without departing from the spirit and scope of the invention. Accordingly, it is not intended that the invention be limited. Changes in the form and proportion of the parts as well as in the substitution of equivalents as circumstances may suggest or render expedient without departing from the spirit or scope of the invention as further defined in the following claims.

What is claimed is:

1. An ornament for a wall comprising:

a lightweight, rigid substrate having a central layer including a first side and a second side, a design surface positioned adjacent said first side of said central layer, and a backing positioned adjacent said second side of said central layer;

a design expression fixed on said design surface; and adhesive means attached to said backing for coupling said ornament to said wall, said adhesive means being both removable from said backing and said wall and reusable.

2. The ornament of claim 1, wherein said substrate is formed in a shape consistent with said design expression.

3. The ornament of claim 2, wherein said central layer is comprised of polystyrene foam.

4. The ornament of claim 2, wherein said adhesive means is comprised of an adherent compound which does not harm or damage said backing or said wall.

5. The ornament of claim 4, wherein said adherent compound in comprised substantially of butyl rubber.

6. The ornament of claim 2, wherein said substrate has a thickness in the range of ⅛ inch to ½ inch.

7. The ornament of claim 2, wherein said substrate has a thickness of approximately ¼ inch.

8. An ornament for a wall comprising:

a design surface having an exposed surface and an unexposed surface, said exposed surface being capable of receiving paints and inks;

a light-weight, rigid supporting material coupled to said unexposed surface of said design surface;

a backing coupled to said supporting material such that said backing and said design surface sandwich said supporting material therebetween; and means for hanging said ornament of said wall coupled to said backing, said means being both removable and reusable.

9. The ornament of claim 8 wherein said design surface, supporting material and backing are shaped consistent with a design on said design surface.

10. The ornament of claim 9 wherein said supporting material is comprised of polystyrene foam.

11. The ornament of claim 10 wherein said hanging means is comprised of an adherent material which is non-volatile.

12. The ornament of claim 11 wherein said hanging means is comprised substantially of butyl rubber.

13. The ornament of claim 10 wherein said supporting material has a thickness in the range of ⅛ inch to ½ inch.

14. An ornament for a wall comprising:

a lightweight, rigid substrate having a central layer manufactured from a light-weight polystyrene foam, said central layer including a first side and a second side, a design surface capable of receiving paint and ink positioned adjacent said first side of said central layer, and a backing positioned adjacent said second side of said central layer, said substrate having a thickness substantially in the range of ⅛ inch to ½ inch;

a design expression fixed on said design surface; and an adhesive attached to said backing for coupling said ornament to said wall, said adhesive being removable from said backing and said wall, reusable, insoluble in water and non-volatile.

* * * * *